US008316558B2

(12) United States Patent
Teteriatnikov et al.

(10) Patent No.: US 8,316,558 B2
(45) **Date of Patent: *Nov. 27, 2012**

(54) SHOE

(75) Inventors: Savva Teteriatnikov, Venice, CA (US); Kenneth J Liu, Torrance, CA (US); Eckhard Knoepke, Redondo Beach, CA (US); Julie Zhu, Redondo Beach, CA (US)

(73) Assignee: Skechers U.S.A., Inc. II, Manhatten Beach, CA (US)

( * ) Notice: Subject to any disclaimer, the term of this patent is extended or adjusted under 35 U.S.C. 154(b) by 583 days.

This patent is subject to a terminal disclaimer.

(21) Appl. No.: 12/432,279

(22) Filed: Apr. 29, 2009

(65) Prior Publication Data

US 2010/0146825 A1 Jun. 17, 2010

Related U.S. Application Data

(60) Provisional application No. 61/122,911, filed on Dec. 16, 2008.

(51) Int. Cl.
*A43B 13/12* (2006.01)
*A43B 13/14* (2006.01)

(52) U.S. Cl. ..... 36/25 R; 36/30 R; 36/31

(58) Field of Classification Search ..... 36/25 R, 36/27, 28, 30 R, 31, 88, 102, 117.4, 103, 36/114

See application file for complete search history.

(56) References Cited

U.S. PATENT DOCUMENTS 4,128,950 A * 12/1978 Bowerman et al. ..... 36/30 R
4,348,821 A * 9/1982 Daswick ..... 36/103
4,439,937 A * 4/1984 Daswick ..... 36/107
4,757,620 A * 7/1988 Tiitola ..... 36/28
4,798,010 A * 1/1989 Sugiyama ..... 36/30 R
4,854,057 A * 8/1989 Misevich et al. ..... 36/114
5,131,173 A * 7/1992 Anderie ..... 36/25 R
5,528,842 A * 6/1996 Ricci et al. ..... 36/27
5,572,805 A * 11/1996 Giese et al. ..... 36/30 R
5,592,757 A 1/1997 Jackinsky
5,718,064 A 2/1998 Pyle
5,822,886 A 10/1998 Luthi et al.
6,341,432 B1 1/2002 Muller
6,389,713 B1 * 5/2002 Kita ..... 36/30 R
6,625,905 B2 * 9/2003 Kita ..... 36/30 R
6,662,469 B2 12/2003 Belley et al.
6,729,046 B2 5/2004 Ellis, III
6,782,639 B1 * 8/2004 Muller ..... 36/28
6,826,852 B2 * 12/2004 Fusco ..... 36/103
7,010,867 B2 3/2006 Brown
7,290,356 B2 * 11/2007 Fuerst ..... 36/77 R
7,779,557 B2 * 8/2010 Teteriatnikov et al. ..... 36/25 R
7,877,897 B2 * 2/2011 Teteriatnikov et al. ..... 36/25 R (Continued)

FOREIGN PATENT DOCUMENTS

EP 0999764 B1 7/2003

(Continued)

*Primary Examiner* — Marie Patterson

(74) *Attorney, Agent, or Firm* — Marshall A. Lerner, Esq.; Marvin H. Kleinberg, Esq.; Kleinberg & Lerner, LLP

(57) ABSTRACT

The present invention provides a shoe having a multi-layer, multi-density midsole where the surfaces between midsole layers have one or more convexities and one or more concavities which collectively contribute to simulating the effect, and imparting the fitness benefits, of walking on a sandy beach or on a giving or uneven surface regardless of the actual hardness of the surface.

9 Claims, 11 Drawing Sheets

U.S. PATENT DOCUMENTS

| | | | | |
|---|---|---|---|---|
| 7,886,460 | B2 * | 2/2011 | Teteriatnikov et al. | 36/25 R |
| 7,941,940 | B2 * | 5/2011 | Teteriatnikov et al. | 36/25 R |
| 2004/0154188 | A1 | 8/2004 | Laska | |
| 2004/0250447 | A1 * | 12/2004 | Ellis, III | 36/25 R |
| 2007/0294915 | A1 * | 12/2007 | Ryu et al. | 36/28 |
| 2008/0016724 | A1 | 1/2008 | Hlavac | |
| 2008/0163513 | A1 | 7/2008 | Chapman et al. | |
| 2008/0229624 | A1 | 9/2008 | Mueller | |
| 2009/0183393 | A1 * | 7/2009 | Lee | 36/103 |
| 2010/0146825 | A1 * | 6/2010 | Teteriatnikov et al. | 36/30 R |
| 2010/0307028 | A1 * | 12/2010 | Teteriatnikov et al. | 36/108 |

FOREIGN PATENT DOCUMENTS

| | | | |
|---|---|---|---|
| EP | 1124462 | B1 | 9/2004 |
| EP | 2005067754 | A1 | 7/2005 |
| JP | 135334 | | 11/1975 |
| JP | 51138237 | | 11/1976 |
| JP | 5781301 | | 5/1982 |
| JP | 57188201 | | 11/1982 |
| JP | 5891906 | | 6/1983 |
| JP | 58165801 | | 9/1983 |
| JP | 58190401 | | 11/1983 |
| JP | 60150701 | | 8/1985 |
| JP | 6131101 | | 3/1986 |
| JP | 61154503 | | 7/1986 |
| JP | 1110603 | | 7/1989 |
| JP | 520528 | A | 10/2001 |
| JP | 247218 | A | 9/2006 |
| JP | 204712 | A | 10/2006 |
| JP | 3917521 | | 2/2007 |
| WO | WO 2009061103 | A1 * | 5/2009 |

* cited by examiner

SHOE

This application claims the benefit of priority based on Provisional Application No. 61/122,911 filed Dec. 16, 2008.

BACKGROUND OF THE INVENTION

1. Field of the Invention

The present invention relates to footwear, in particular, to a shoe with fitness benefits. The fitness benefits are experienced through a unique walking action in which the foot strike mimics the effect of walking on a sandy beach or on an uneven surface. This is accomplished through a multi-layer, multi-density midsole where the surfaces between midsole layers have one or more convexities and one or more concavities.

2. Description of the Related Art

Shoes are designed for many purposes—from protection on the job to performance on the track or court to special occasions and everyday lifestyle. Shoes have also been used to promote physical health and activity. Increasingly, shoes have given users fitness benefits. Many shoes have attempted to provide users the benefit of improving the user's fitness by simply walking while wearing such shoes. However, there continues to be a need for such shoes that improve the user's health yet are comfortable and easy to use.

Walking is one of the easiest and most beneficial forms of exercise. When done properly and with the appropriate footwear, it strengthens the heart, improves cardiovascular health, increases one's stamina and improves posture. It also helps to strengthen one's muscles and maintain joint flexibility.

Prior art shoes have attempted to improve the user's fitness by mimicking walking barefoot. These shoes have included a midsole made of hard material throughout the entire midsole except for a recess in the rear region of the shoe in which a softer, cushioning material is placed. See, for example, U.S. Pat. No. 6,341,432 to Muller. Such shoes include an abrupt, discrete pivot point on the bottom surface of the midsole in the middle region of the shoe where the cushioning material ends and the hard material of the midsole begins. Consequently, in every step taken during normal walking while wearing such shoes, the user is forced to overcome this abrupt, discrete pivot point. This can result in significant pain and discomfort. See also, for example, U.S. Pat. No. 6,782,639 to Müller.

The present invention aims to provide a way of mimicking walking on a sandy beach or on a giving or uneven surface, while not inducing any significant pain or discomfort from doing so. By mimicking walking on a sandy beach and/or on an uneven surface, the present invention aims to significantly increase the fitness and health benefits of everyday walking by requiring the user to exert additional effort and energy while walking and to use muscles that the user otherwise would not use if wearing ordinary footwear, again all without inducing any substantial pain or discomfort.

SUMMARY OF THE INVENTION

It is an object of the present invention to provide a shoe that mimics the effects, and imparts the fitness benefits of, walking on a sandy beach or on a giving or uneven surface without inducing any significant pain or discomfort from doing so. The present invention is a shoe comprising an upper, an outsole, and a midsole, each having a medial side and a lateral side. In a preferred embodiment, the midsole is affixed to the upper and the outsole is affixed to midsole. The upper, midsole, and outsole each has a frontmost point and a rearmost point substantially opposite the frontmost point. When the shoe is being worn by a user, each frontmost point and each rearmost point is oriented with respect to one another such that each frontmost point is closer to the user's toes than each rearmost point while at the same time each rearmost point is closer to the user's heel than each frontmost point.

The shoe has a front portion and a rear portion substantially opposite the front portion. When the shoe is being worn by a user, the front portion and the rear portion are oriented with respect to one another such that the front portion is closer to the user's toes than the rear portion while at the same time the rear portion is closer to the user's heel than the front portion.

The shoe has a front tip that is located at the farthest forward point of the shoe when moving from the rear portion to the front portion. The shoe has a rear tip that is located at the farthest rearward point of the shoe when moving from the front portion to the rear portion. In a preferred embodiment, the front tip coincides with the frontmost point of the upper, the frontmost point of the midsole, or the frontmost point of the outsole while the rear tip coincides with the rearmost point of the upper, the rearmost point of the midsole, or the rearmost point of the outsole. In a preferred embodiment the frontmost point of the upper, the frontmost point of the midsole, and the frontmost point of the outsole are all located relatively close to one another while the rearmost point of the upper, the rearmost point of the midsole, and the rearmost point of the outsole are all located relatively close to one another.

The upper, midsole, and outsole each has a toe region. The toe region includes the region that extends substantially from the medial side to the lateral side at a location that begins in the vicinity of the front tip of the shoe and extends from there to a location that is approximately one third of the distance toward the rear tip of the shoe.

The upper, midsole, and outsole each has a heel region. The heel region includes the region that extends substantially from the medial side to the lateral side at a location that begins in the vicinity of the rear tip of the shoe and extends from there to a location that is approximately one third of the distance toward the front tip of the shoe.

The upper, midsole, and outsole each has a middle region. The middle region includes the region that extends substantially from the medial side to the lateral side at a location that extends approximately between the toe region and the heel region.

The midsole further comprises an upper layer and a lower layer, the upper layer having a first density and the lower layer having a second density different from the first density, and the upper layer having a top surface and a bottom surface substantially opposite the top surface wherein the bottom surface has two or more convexities, or two or more concavities, or a single convexity and a single concavity.

In a preferred embodiment, the invention includes an outsole that, when no load is applied, curves continuously upward in a direction toward the upper beginning at a location near the middle region of the outsole and ending at a location near the rearmost point of the upper. In this preferred embodiment, the midsole has two layers, an upper layer and a lower layer, and the upper layer and the lower layer each extend from at least the vicinity of the front tip of the shoe to at least the vicinity of the rear tip of the shoe. The upper layer is made from a material having a first density sufficiently dense to support and stabilize the foot. Typically, the upper layer has a density between about 0.400 and about 0.500 grams per cubic centimeter and a durometer between about 50 and about 75 on Shore A (ASTM D2240). The upper layer typically has a relatively low compressibility so that it compresses a relatively low, or small, amount under a given load. The lower layer, which may or may not be made of the same material as the upper layer, has a second density that is different from the first density and is sufficiently low in density and high in compressibility so as to allow the lower layer to compress and deform a higher, or greater, amount under a given weight than the upper layer would compress and deform under that same weight. Typically, the lower layer has a density between about 0.325 and about 0.419 grams per cubic centimeter and a durometer between about 15 and about 38 on Shore A (ASTM D2240). The density of the lower layer is sufficiently low and the compressibility of the lower layer is sufficiently high so that under normal walking conditions the user's foot, first in the heel region, then in the middle region, and then finally in the toe region, sinks toward the ground as the lower layer compresses and deforms due to the lower layer's relatively low density and/or high compressibility.

Thus, during walking while wearing a preferred embodiment of the instant invention, when the curved heel region of the outsole strikes the ground, the heel region of the lower layer, which is less dense and more easily compressed than the upper layer, deforms to a relatively large degree compared to the upper layer. After each such initial heel region contact with the ground, the user's heel continues to sink or move toward the ground more than it would sink or move in a conventional shoe. This sinking or downward movement is due primarily to deflection of the heel region of the outsole and compression of the heel region of the midsole as they each respond to the increasing weight being transmitted through the user's heel as the step progresses and the user's heel continues to bear an increasing amount of the user's weight until it reaches a maximum. The impact is akin to a heel striking a sandy beach or a giving or uneven surface. Then, as the user's weight begins to shift toward the middle region of the shoe, the shoe rolls forward in a smooth motion, without the user having to overcome any abrupt or discrete pivot points. Then the lower layer of the midsole in the middle region and then in the toe region compresses and deforms under the increasing weight of the user's foot in those regions as the step progresses. This compression and deformation allows the user's foot to sink further toward the ground than would be the case with a conventional shoe. The user then completes the step by pushing off with the forefoot ball area of the user's foot. This push-off further compresses and deforms the lower layer in the toe region.

The convexities and concavities in the instant invention are all identified as being on, and being a part of, the bottom surface of the upper layer. Under this convention, each convexity identified herein is, to some degree, an outward bulge of the bottom surface of the upper layer and each concavity identified herein is, to some degree, an inward depression in the bottom surface of the upper layer. Each convexity's outward bulge means that the upper layer is relatively thick wherever it has a convexity. This increased thickness of the upper layer corresponds to a decrease in thickness of the lower layer at each location where the lower layer is opposite a convexity. Similarly, each concavity's inward depression means that the upper layer is relatively thin wherever it has a concavity. This increased thinness of the upper layer corresponds to a decreased thinness, i.e., a thickening, of the lower layer at each location where the lower layer is opposite a concavity.

Each convexity and concavity has at least five primary variables that control the effect of each convexity and each concavity. These primary variables are (1) the location where each convexity and concavity is located on the bottom surface of the upper layer, (2) the sharpness or shallowness of the convexity or concavity, i.e., its radius or radii of curvature, (3) the length or wavelength of each convexity or concavity as measured from a point where it begins to a point where it ends, (4) the amplitude, i.e., the greatest height of each convexity or the greatest depth of each concavity, and (5) the firmness or compressibility of the upper layer material with which each convexity or concavity is formed. These variables are some of the primary means by which the effects of the shoe on the user are controlled. These effects comprise primarily the degree of softness or hardness felt by the foot throughout each step while wearing the shoe, the amount of energy and effort needed for the user to complete each step, and the amount of muscle use, control and coordination necessary for the user to maintain the user's balance throughout each step.

The degree of softness or hardness felt by the foot immediately after the heel strike is controlled primarily by a concavity located in the heel region. This concavity is typically relatively large overall, i.e., it typically has a long length, a large radius or radii of curvature, and a large amplitude. This relatively large concavity allows a relatively thick lower layer to be used in the heel region that can absorb and soften the initial heel strike of each step. Such a concavity could also be located in the middle region or the toe region of the upper layer. Whereas each concavity imparts a relatively soft feel to the user's foot while walking, each convexity imparts a relatively hard feel to the user's foot while walking. This relative hardness is due to the decreased thickness of the soft, highly compressible lower layer at each location where a convexity occurs.

The amount of energy and effort required by the user in each step is related to the degree of softness or hardness felt by the user as discussed in the preceding paragraph insofar as each concavity corresponds to a softer feel which, in turn, requires more energy and effort to overcome in each step.

The amount of muscle use, control and coordination necessary for the user to maintain the user's balance throughout each step increases in direct proportion to each one of the following: (1) increased concavity size, and (2) increased compressibility of the lower layer. Increased concavity size, primarily in the form of length and amplitude, corresponds to a thicker lower layer. The compressibility of the lower layer is a physical property inherent in the material out of which the lower layer is made. It is a measure of the readiness with which the lower layer compresses under a given load. A high compressibility means that the lower layer is highly compressible and can be compressed a high amount with relative ease. As the compressibility increases, the user must use more muscle control and coordination to maintain the user's balance during each step as the weight of the user compresses the lower layer. This compression is accompanied by a downward movement of the user's foot as it compresses the lower layer during each step. This downward compression movement requires balancing by the user to accommodate the inherent lateral and transverse instability that accompanies the compression. This inherent lateral and transverse instability is also affected by the thickness of the lower layer. This thickness, as mentioned above, increases as concavity size increases. As this thickness increases, the inherent lateral and transverse instability also increases. Thus, concavities contribute to a less stable walking nature of the shoe. The relative opposite effect is achieved with a convexity. Each convexity in the upper layer corresponds to a relative thinness in the lower layer. This relative thinness in the lower layer means that the user is not required to undergo as much balancing as when the lower layer is thick, primarily because the relatively unstable lower layer is relatively minimized where each convexity occurs in the corresponding upper layer. Thus, convexities contribute to a more stable walking nature of the shoe.

One of the primary objectives of shoes having midsoles as disclosed herein is to provide fitness benefits to the user by requiring the user, by merely walking, to exert more energy and effort than would otherwise be required when walking while wearing conventional shoes, and to require the user to use, control, and coordinate muscles in ways that such muscles would not be used, controlled or coordinated when walking while wearing conventional shoes. Just as walking on a sandy beach requires more energy and effort than walking on a hard, flat surface, the relatively thick, highly compressible lower layer of the midsole in the area of the concavities requires that a user wearing such shoes exert more energy and effort to walk than is required while wearing conventional shoes. The extra thickness and high compressibility of the lower layer in the area of the concavities further allows the shoes to flex more, both transversely and laterally, than conventional shoes. In order for the user to maintain the user's balance and a normal walking gait under such flexure conditions, the user is required to use muscles and to control and coordinate muscles to an extent greater than is required when walking while wearing conventional shoes. The use of such muscles in such a manner further imparts a fitness benefit to the user. These and other fitness benefits of the instant shoe include, among others: muscle strengthening and toning, better posture, improved cardiovascular health, less stress on joints, and improved circulation.

BRIEF DESCRIPTION OF THE DRAWINGS

For a further understanding of the objects and advantages of the present invention, reference should be had to the following detailed description, taken in conjunction with the accompanying drawings, in which like parts are given like reference numbers and wherein.

DESCRIPTION OF PREFERRED EMBODIMENTS

The invention will now be described with reference to FIGS. 1 and 1A, which illustrate a side elevation view in cross section of the midsole 103. The outsole 105 is not part of the midsole 103. A sockliner 101 is not part of the midsole 103. The midsole 103 is shown beneath the sockliner 101. The outsole 105 of the shoe is beneath the midsole 103. The dual density midsole is located between the shoe upper (not shown) and the outsole 105.

Figure 1:
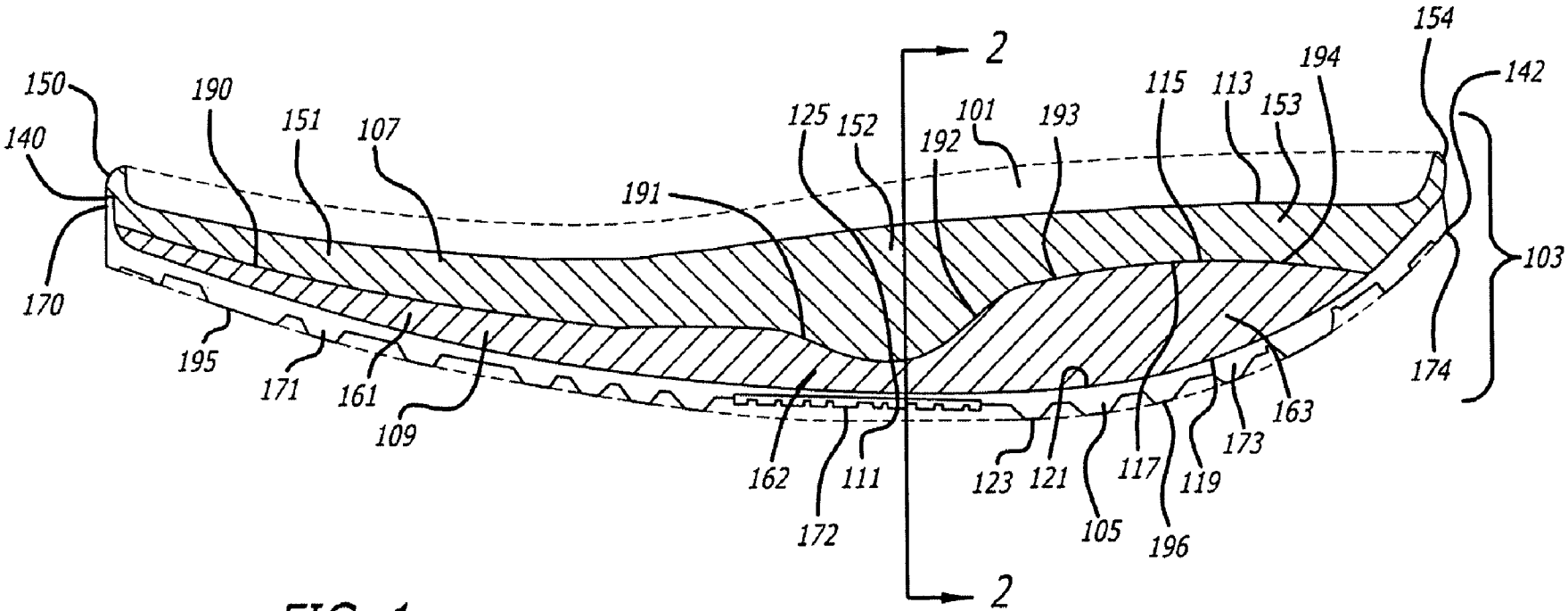
FIG. 1 is a side elevation view in cross section of an embodiment of the midsole and outsole of the shoe.
Figure 1A:
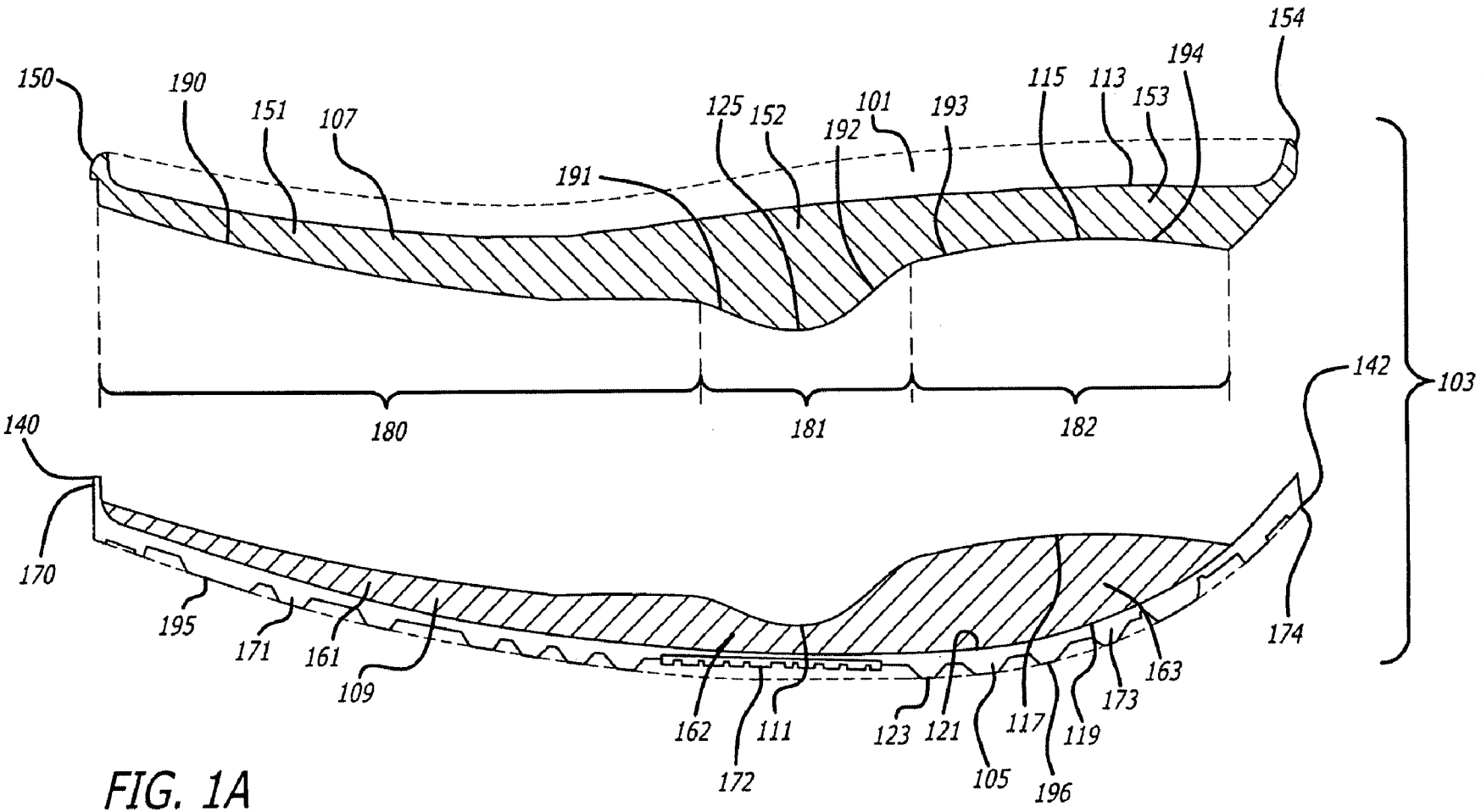
FIG. 1A an exploded view of FIG. 1.

The midsole 103, as shown in FIG. 1A, comprises an upper layer 107 and a lower layer 109. The upper layer 107 and/or the lower layer 109 may themselves each be comprised of two or more sub-layers. The upper layer 107 has a top surface 113 substantially opposite a bottom surface 115. The lower layer 109 has a top surface 117 substantially opposite a bottom surface 121.

The shoe has a front tip 140 located at the farthest point toward the front of the shoe and a rear tip 142 located at the farthest point toward the rear of the shoe. The upper layer 107 includes a toe region 151 that extends substantially from the medial side of the shoe to the lateral side of the shoe at a location that begins in the vicinity of the front tip 140 and extends from there to a location that is approximately one third of the distance toward the rear tip 142. The lower layer 109 includes a toe region 161 that extends substantially from the medial side of the shoe to the lateral side of the shoe at a location that begins in the vicinity of the front tip 140 and extends from there to a location that is approximately one third of the distance toward the rear tip 142. The outsole 105 includes a toe region 171 that extends substantially from the medial side of the shoe to the lateral side of the shoe at a location that begins in the vicinity of the front tip 140 and extends from there to a location that is approximately one third of the distance toward the rear tip 142.

The upper layer 107 includes a heel region 153 that extends substantially from the medial side of the shoe to the lateral side of the shoe at a location that begins in the vicinity of the rear tip 142 and extends from there to a location that is approximately one third of the distance toward the front tip 142. The lower layer 109 includes a heel region 163 that extends substantially from the medial side of the shoe to the lateral side of the shoe at a location that begins in the vicinity of the rear tip 142 and extends from there to a location that is approximately one third of the distance toward the front tip 140. The outsole 105 includes a heel region 173 that extends substantially from the medial side of the shoe to the lateral side of the shoe at a location that begins in the vicinity of the rear tip 142 and extends from there to a location that is approximately one third of the distance toward the front tip 140.

The upper layer 107 includes a middle region 152 that extends substantially from the medial side of the shoe to the lateral side of the shoe at a location that extends approximately between the toe region 151 and the heel region 153. The lower layer 109 includes a middle region 162 that extends substantially from the medial side of the shoe to the lateral side of the shoe at a location that extends approximately between the toe region 161 and the heel region 163. The outsole 105 includes a middle region 172 that extends substantially from the medial side of the shoe at a location that extends approximately between the toe region 171 and the heel region 173.

Typically, the lower layer 109 is on average thicker in the heel region 163 than it is in the toe region 161. Typically, the thickness of the lower layer 109 is less than about 45 millimeters in the heel region 163 and has an average thickness in the heel region 163 of at least about 6.5 millimeters, and is less than about 25 millimeters in the middle region 162 and the toe region 161 and has an average thickness in the middle region 162 and the toe region 161 of at least 3 millimeters. The upper layer 107 has a first density and the lower layer 109 has a second density that is different from the first density and is typically less dense than the first density. The upper layer 107 has a first compressibility and the lower layer 109 has a second compressibility that is different from the first compressibility. The compressibility of the lower layer 109 is typically relatively high. Due to this relatively high compressibility, the lower layer 109 undergoes a relatively high amount of deformation when subjected to a given load. The upper layer 107 is typically made from polyurethane, polyvinyl chloride, rubber or thermal plastic rubber. However, the upper layer 107 can be made from any other material without departing from the scope of the present invention. Typically the upper layer 107 will have a density of between about 0.400 and about 0.500 grams per cubic centimeter and a durometer between about 50 and about 75 Shore A (ASTM D2240). The lower layer 109 is made of a compressible and deformable yet resilient material which may or may not be the same material of which the upper layer 107 is made. Typically the lower layer 109 will have a density of between about 0.325 and about 0.419 grams per cubic centimeter and a durometer between about 15 and about 38 Shore A (ASTM D2240). The upper layer 107 has a top surface 113 that is typically positioned below an insole board (not shown) which is typically positioned below the sockliner 101. The upper layer 107 also has a bottom surface 115 that is secured to and in substantially continuous contact with the top surface 117 of the lower layer 109 by either friction and/or an adhesive and/or other similar means. Alternatively, substantially the entire bottom surface 115 of the upper layer 107 may be molded to substantially the entire top surface 117 of the lower layer 109. The outsole 105 has a top surface 119. The bottom surface 121 of the lower layer 109 is positioned above the top surface 119 of outsole 105.

When viewed while moving from the frontmost point 150 of the upper layer 107 to the rearmost point 154 of the upper layer 107, the bottom surface 115 of the upper layer 107, as shown in a preferred embodiment in FIG. 1A, has a convexity 180 that comprises at least a downward curve 190 located in at least a portion of the toe region 151. All convexities identified by an element number in this specification are convexities that, to some degree, protrude from, and are part of, their respective bottom surface 115, 315, or 815 of the respective upper layer 107, 307 or 807. Downward curve, as used here and throughout this specification, unless otherwise noted, refers to a direction that moves toward the ground from any specified location on the shoe when viewed while moving from a front tip 142, 342, or 842 to a respective rear tip 140, 340, or 840 and while the shoe is oriented in its typical upright position where a bottom surface 123, 323 or 823 of the respective outsole 105, 305 or 805 is in unloaded contact with the ground. The downward curve 190 of convexity 180 begins at, or near the vicinity of, the frontmost point 150 of the upper layer 107 and gradually and continuously descends downwardly from there through at least a portion of the toe region 151. The portion of the upper layer 107 indicated by lines extending from, and associated with, element number 180 indicates the approximate range wherein convexity 180 is typically primarily located. Convexity 180 may, or may not, be entirely located within the range indicated by the lines extending from, and associated with, element number 180. Convexity 180, as shown in a preferred embodiment in FIG. 1A, is relatively shallow due to its large radius, or radii, of curvature. Convexity 180 may comprise a curve or curves in addition to downward curve 190. The radius of curvature throughout convexity 180 may be completely constant, may have one or more constant portions mixed with one or more non-constant portions, or may be completely non-constant. Downward curve 190, as well as any other curve or curves that are part of convexity 180, may, at any point on any of those curves, have a slope somewhere between negative infinity and positive infinity and can include a slope that is zero, gradual, moderate, steep, vertical or somewhere between any of those amounts. Although the downward curve 190 of convexity 180 is shown in FIG. 1A as beginning near the frontmost point 150, downward curve 190 of convexity 180 may instead begin at some other location on the upper layer 107. Only a portion of convexity 180 may be located in the toe region 151. Alternatively, all or substantially all of convexity 180 may be located in the toe region 151. Convexity 180, or a portion thereof, may occupy all of the toe region 151. Alternatively, convexity 180, or a portion thereof, may occupy a substantial portion of the toe region 151. Convexity 180 has a first wavelength and a first amplitude.

Figure 2:
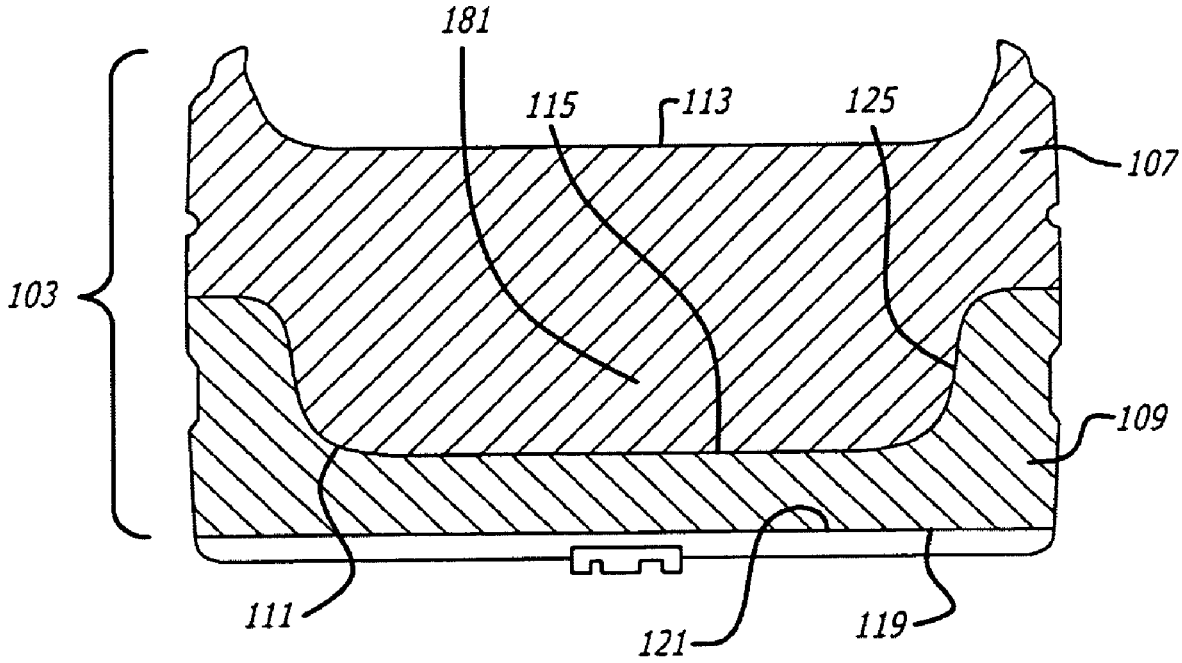
FIG. 2 is a front elevation view in cross section of the midsole and outsole shown in FIG. 1 along line 2-2 in the direction of the appended arrows.

The bottom surface 115 of the upper layer 107, as shown in FIG. 1A, has a convexity 181 that comprises at least a downward curve 191 located in at least a portion of the middle region 152. In this preferred embodiment, convexity 181 further comprises at least an upward curve 192. Upward curve, as used here and throughout this specification, unless otherwise noted, refers to a direction that moves away from the ground from any specified location on the shoe when viewed while moving from a front tip 142, 342, or 842 to a respective rear tip 140, 340, or 840 and while the shoe is oriented in its typical upright position where a bottom surface 123, 323 or 823 of the outsole 105, 305 or 805 is in unloaded contact with the ground. Downward curve 191 may or may not be contiguous with upward curve 192. Downward curve 191 descends downwardly in at least a portion of the middle region 152. Upward curve 192 ascends upwardly in at least a portion of the middle region 152. The portion of the upper layer 107 indicated by lines extending from, and associated with, element number 181 indicates the approximate range wherein convexity 181 is typically primarily located. Convexity 181 may, or may not, be entirely located within the range indicated by the lines extending from, and associated with, element number 181. Convexity 181 has a relatively pronounced bulge due to its relatively small radius, or radii, of curvature. Convexity 181 may comprise a curve or curves in addition to downward curve 191 and upward curve 192. The radius of curvature throughout convexity 181 may be completely constant, may have one or more constant portions mixed with one or more non-constant portions, or may be completely non-constant. Downward curve 191, upward curve 192, as well as any other curve or curves that are part of convexity 181, may, at any point on any of those curves, have a slope somewhere between negative infinity and positive infinity and can include a slope that is zero, gradual, moderate, steep, vertical or somewhere between any of those amounts. Although the downward curve 191 of convexity 181 is shown in FIG. 1A as beginning near the middle of the middle region 152 and ending at a location closer to the heel region 153 than the middle of the middle region 152, downward curve 191 of convexity 181 may instead begin at some other location on the upper layer 107 and end at some other location on the upper layer 107. Although the upward curve 192 of convexity 181 is shown in FIG. 1A as beginning near the middle of the middle region 152 and ending in the middle region at a location near the heel region 153, upward curve 192 of convexity 181 may instead begin at some other location on the upper layer 107 and end at some other location on the upper layer 107. Only a portion of convexity 181 may be located in the middle region 152. Alternatively, all or substantially all of convexity 181 may be located in the middle region 152. Convexity 181, or a portion thereof, may occupy all of the middle region 152. Alternatively, convexity 181, or a portion thereof, may occupy a substantial portion of the middle region 152. Convexity 181 has a second wavelength that is typically different from the first wavelength of convexity 180. Convexity 181 has a second amplitude that is typically different from the first amplitude of convexity 180. Line 2-2 is at or near the lowest point of convexity 181. The primary purpose of convexity 181 is to reduce—but not eliminate—compression and deformity of the lower layer 109 in the region of the convexity 181 and to provide stability. FIG. 2 shows how convexity 181 extends substantially from the lateral to medial side of the upper layer 107. Convexity 180 may or may not be contiguous with convexity 181.

The bottom surface 115 of the upper layer 107, as shown in FIG. 1A, has a concavity 182 that comprises at least an upward curve 193 located in at least a portion of the heel region 153. All concavities identified by an element number in this specification are concavities that, to some degree, form a depression in, and are part of, the respective bottom surface 115, 315, or 815 of the respective upper layer 107, 307 or 807. In this preferred embodiment, concavity 182 further comprises at least a downward curve 194. Upward curve 193 may or may not be contiguous with downward curve 194. Upward curve 193 ascends upwardly in at least a portion of the heel region 153. Downward curve 194 descends downwardly in at least a portion of the heel region 153. The portion of the upper layer 107 indicated by lines extending from, and associated with, element number 182 indicates the approximate range wherein concavity 182 is typically primarily located. Concavity 182 may, or may not, be entirely located within the range indicated by the lines extending from, and associated with, element number 182. Concavity 182 has a relatively moderate depression due to its relatively moderate radius, or radii, of curvature. Concavity 182 may comprise a curve or curves in addition to upward curve 193 and downward curve 194. The radius of curvature throughout concavity 182 may be completely constant, may have one or more constant portions mixed with one or more non-constant portions, or may be completely non-constant. Upward curve 193, downward curve 194, as well as any other curve or curves that are part of concavity 182, may, at any point on any of those curves, have a slope somewhere between negative infinity and positive infinity and can include a slope that is zero, gradual, moderate, steep, vertical or somewhere between any of those amounts. Although the upward curve 193 of concavity 182 is shown in FIG. 1A as beginning at a location where the heel region 153 and the middle region 152 transition into one another, the upward curve 193 of concavity 182 could instead begin at some other location on the upper layer 107. Although the upward curve 193 of concavity 182 is shown in FIG. 1A as ending at a location near the middle of the heel region 153, upward curve 193 may instead end at some other location on the upper layer 107. Although the downward curve 194 of concavity 182 is shown in FIG. 1A as beginning near the middle of the heel region 153 and ending in the vicinity of the rearmost point 154 of the upper layer 107, downward curve 194 of concavity 182 may instead begin at some other location on the upper layer 107 and end at some other location on the upper layer 107. Convexity 181 may or may not be contiguous with concavity 182. Only a portion of concavity 182 may be located in the heel region 153. Alternatively, all or substantially all of concavity 182 may be located in the heel region 153. Concavity 182, or a portion thereof, may occupy all of the heel region 153. Alternatively, concavity 182, or a portion thereof, may occupy a substantial portion of the heel region 153. Concavity 182 has a third wavelength that is typically different from both the first wavelength of convexity 180 and the second wavelength of convexity 181. Concavity 182 has a third amplitude that is typically different from both the first amplitude of convexity 180 and the second amplitude of convexity 181.

In preferred embodiments, the top surface 117 of the lower layer 109 of the midsole 103 is in substantially continuous contact with the bottom surface 115 of the upper layer 107 of the midsole. Due to this substantially continuous contact between top surface 117 and bottom surface 115 in these preferred embodiments, each convexity in the bottom surface 115 has a corresponding concavity in the top surface 117 and each concavity in the bottom surface 115 has a corresponding convexity in the top surface 117. In other embodiments, such substantially continuous contact between top surface 117 and bottom surface 115 may not be present.

The outsole 105 has a top surface 121 and a bottom surface 123. The outsole 105 may curve upwardly in the heel region. When the shoe is in its typical upright, unloaded state, the frontmost point 170 is relatively high above the ground. From a point at or near the vicinity of the frontmost point 170, the outsole 105 has a gradual downward curve 195 that continues through at least a portion of the toe region 171 of the outsole 105 until it becomes straight or nearly straight at some point in the middle region 172 of the outsole 105. Starting in this middle region 172, the outsole 105 has a gradual, upward curve 196 that continues to curve upward through at least a portion of the heel region 173 of the outsole 105. This gradual upward curve 196 typically continues until the outsole 105 approaches the vicinity of the rear tip 142 of the shoe. This upward curve 196 is typically sharper than downward curve 195 in the toe region 171. Upward curve 196 may be substantially sharper than shown in FIG. 1A or substantially shallower than shown in FIG. 1A. The bottom surface 123 of the outsole 105 typically contains grooves and/or patterns for optimal traction and wear.

FIG. 2 illustrates a front elevation view in cross section of FIG. 1 along line 2-2 in the direction of the appended arrows. FIG. 2 shows the construction and placement of the upper layer 107 on top of the lower layer 109 with the convexity 181 sitting in the congruent curved recess or depression 111. The cross sectional shape of the bottom surface 115 of the upper layer 107 and the top surface 117 of the lower layer 109 at line 2-2 is shown in FIG. 2 as a single line that is horizontal at one end, then dips downwardly toward the middle, is horizontal in the middle, then slopes upwardly at the other end and is horizontal at the other end.

The invention will now be described with reference to a preferred embodiment shown in FIGS. 3 and 3A. This embodiment shows a side elevation view in cross section of the midsole 303 and the outsole 305 of the shoe.

The midsole 303, as shown, comprises two layers. Typically, the lower layer 309 of the midsole 303 is on average thicker in the heel region 363 of the shoe than it is in the toe region 361. Typically, the thickness of the lower layer 309 is less than about 45 millimeters thick in the heel region 363 of the shoe and has an average thickness in the heel region 363 of at least about 6.5 millimeters, and is less than about 25 millimeters thick in the middle region 362 and the toe region 361 of the shoe and has an average thickness in the middle region 362 and the toe region 361 of at least about 3 millimeters. The upper layer 307 has a first density and the lower layer 309 has a second density different from the first density and is typically less dense than the first density. The upper layer 307 has a first compressibility and the lower layer 309 has a second compressibility that is different from the first compressibility. The compressibility of the lower layer 309 is typically relatively high. Due to this relatively high compressibility, the lower layer 309 undergoes a relatively high amount of deformation when subjected to a given load. The upper layer 307 is typically made from polyurethane, polyvinyl chloride, rubber or thermal plastic rubber. However, the upper layer 307 can be made from any other material without departing from the scope of the present invention. Typically the upper layer 307 will have a density of between about 0.400 and about 0.500 grams per cubic centimeter and a durometer between about 50 and about 75 Shore A (ASTM D2240). The lower layer 309 is made of a compressible and deformable yet resilient material which may or may not be the same material of which the upper layer 307 is made. Typically the lower layer 309 will have a density of between about 0.325 and about 0.419 grams per cubic centimeter and a durometer between about 15 and about 38 Shore A (ASTM D2240). The top surface 313 of the upper layer 307 is typically positioned below an insole board (not shown) which is typically positioned below the sockliner 301. The upper layer 307 has a bottom surface 315 that is located above the top surface 317 of the lower layer 309. The lower layer 309 has a bottom surface 321. The outsole 305 has a top surface 319. The bottom surface 321 of the lower layer 309 is located above the top surface 319 of the outsole 305

Figure 3:
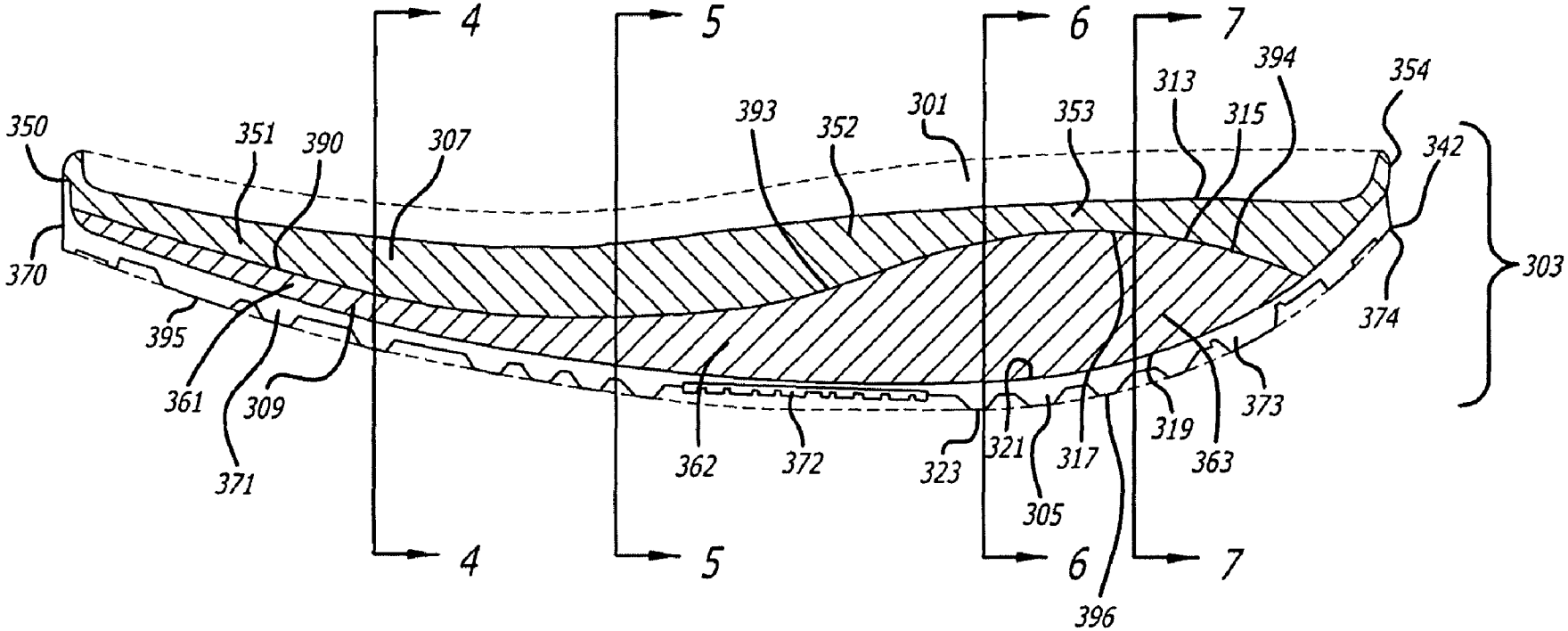
FIG. 3 is a side elevation view in cross section of an alternative embodiment of the midsole and outsole of the shoe.
Figure 3A:
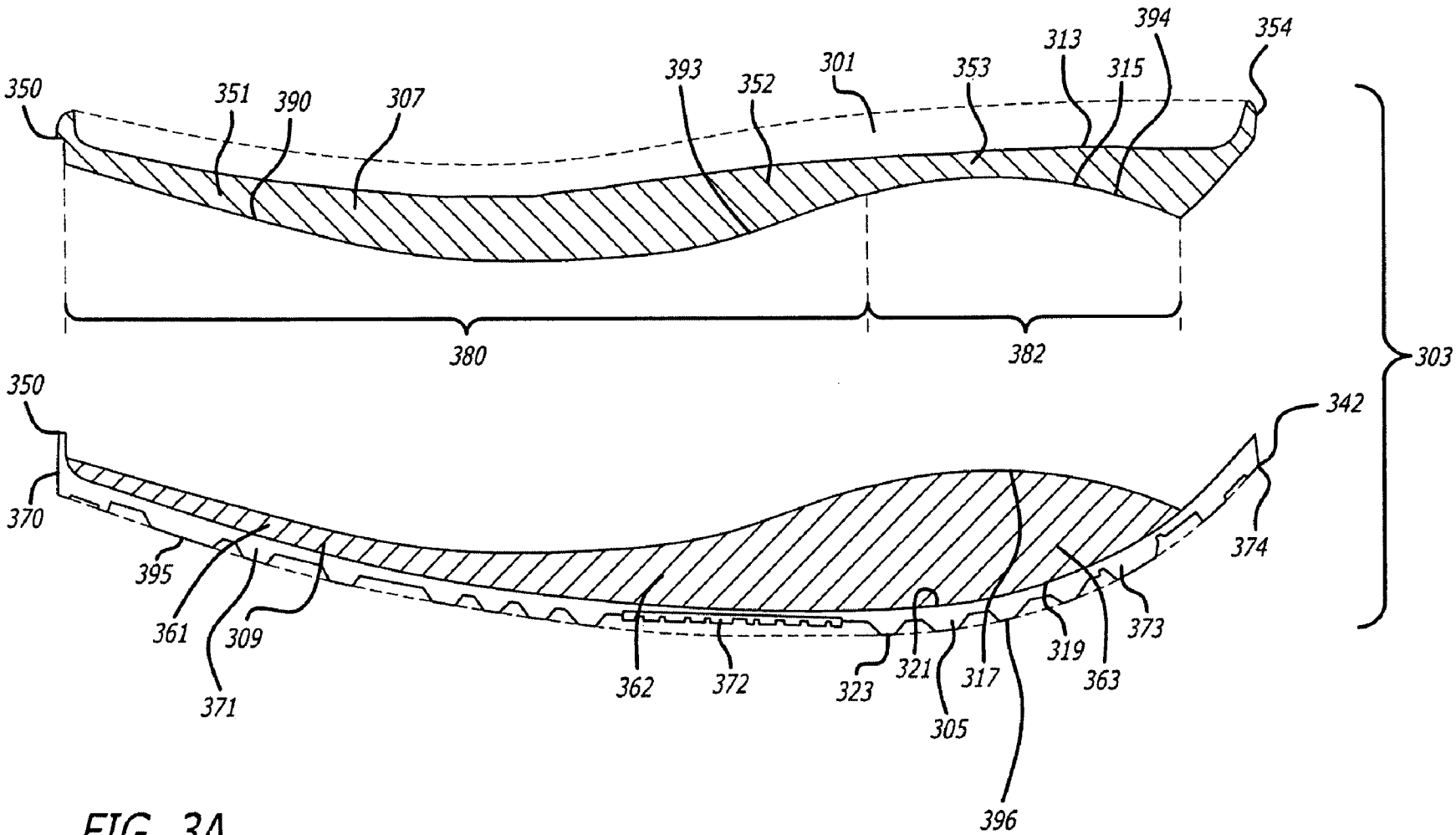
FIG. 3A an exploded view of FIG. 3.

The bottom surface 315 of the upper layer 307, as shown in a preferred embodiment in FIG. 3A, has a convexity 380 that comprises at least a downward curve 390 located in at least a portion of the toe region 351. The downward curve 390 of convexity 380 begins at, or near the vicinity of, the frontmost point 350 of the upper layer 307 and gradually and continuously descends downwardly from there through at least a portion of the toe region 351. The portion of the upper layer 307 indicated by lines extending from, and associated with, element number 380 indicates the approximate range wherein convexity 380 is typically primarily located. Convexity 380 may, or may not, be entirely located within the range indicated by the lines extending from, and associated with, element number 380. Convexity 380, as shown in a preferred embodiment in FIG. 3A, is relatively shallow due to its large radius, or radii, of curvature. Convexity 380 may comprise a curve or curves in addition to downward curve 390. The radius of curvature throughout convexity 380 may be completely constant, may have one or more constant portions mixed with one or more non-constant portions, or may be completely non-constant. Downward curve 390, as well as any other curve or curves that are part of convexity 380, may, at any point on any of those curves, have a slope somewhere between negative infinity and positive infinity and can include a slope that is zero, gradual, moderate, steep, vertical or somewhere between any of those amounts. Although the downward curve 390 of convexity 380 is shown in FIG. 3A as beginning near the frontmost point 350, downward curve 390 of convexity 380 may instead begin at some other location on the upper layer 307. Although convexity 380 is shown in FIG. 3A as ending at a location in the middle region 352 or the location where the middle region 352 transitions into the heel region 353, convexity 380 may end at some other location on the upper layer 307.

The bottom surface 315 of the upper layer 307, as shown in FIG. 3A, has a concavity 382 that comprises at least an upward curve 393 located in at least a portion of the heel region 353. In this preferred embodiment, concavity 382 further comprises at least a downward curve 394. Upward curve 393 may or may not be contiguous with downward curve 394. Upward curve 393 ascends upwardly in at least a portion of the heel region 353. Downward curve 394 descends downwardly in at least a portion of the heel region 353. The portion of the upper layer 307 indicated by lines extending from, and associated with, element number 382 indicates the approximate range wherein concavity 382 is typically primarily located. Concavity 382 may, or may not, be entirely located within the range indicated by the lines extending from, and associated with, element number 382. Concavity 382 has a relatively moderate depression due to its relatively moderate radius, or radii, of curvature. Concavity 382 may comprise a curve or curves in addition to upward curve 393 and downward curve 394. The radius of curvature throughout concavity 382 may be completely constant, may have one or more constant portions mixed with one or more non-constant portions, or may be completely non-constant. Upward curve 393, downward curve 394, as well as any other curve or curves that are part of concavity 382, may, at any point on any of those curves, have a slope somewhere between negative infinity and positive infinity and can include a slope that is zero, gradual, moderate, steep, vertical or somewhere between any of those amounts. Although the upward curve 393 of concavity 382 is shown in FIG. 3A as beginning at a location where the middle region 352 and the heel region 353 transition into one another, the upward curve 393 of concavity 382 could instead begin at some other location on the upper layer 307. Although the upward curve 393 of concavity 382 is shown in FIG. 3A as ending at a location near the transition between the middle region 352 and the heel region 353, upward curve 393 may instead end at some other location on the upper layer 307. Although the downward curve 394 of concavity 382 is shown in FIG. 3A as beginning at a location near the transition between the middle region 352 and the heel region 353 and ending in the vicinity of the rearmost point 354 of the upper layer 307, downward curve 394 of concavity 382 may instead begin at some other location on the upper layer 307 and end at some other location on the upper layer 307. Convexity 380 may or may not be contiguous with concavity 382.

The outsole 305 has a top surface 319 and a bottom surface 323. The outsole 305 may curve upwardly in the heel region. When the shoe is in its typical upright, unloaded state, the frontmost point 370 is relatively high above the ground. From a point at or near the vicinity of the frontmost point 370, the outsole 305 has a gradual downward curve 395 that continues through at least a portion of the toe region 371 of the outsole 305 until it reaches a virtually flat surface in the middle region 372 of the outsole 305. Starting in this middle region 372, the outsole 305 has a gradual, upward curve 396 that continues to curve upward through at least a portion of the heel region 373 of the outsole 305. This gradual upward curve 396 typically continues until the outsole 305 approaches the vicinity of the rear tip 342 of the shoe. This upward curve 396 is typically sharper than the curve in the toe region 371. Upward curve 396 may be substantially sharper than shown in FIG. 3A or substantially shallower than shown in FIG. 3A. The bottom surface 323 of the outsole 305 typically contains grooves and/or patterns for optimal traction and wear.

Figure 4:
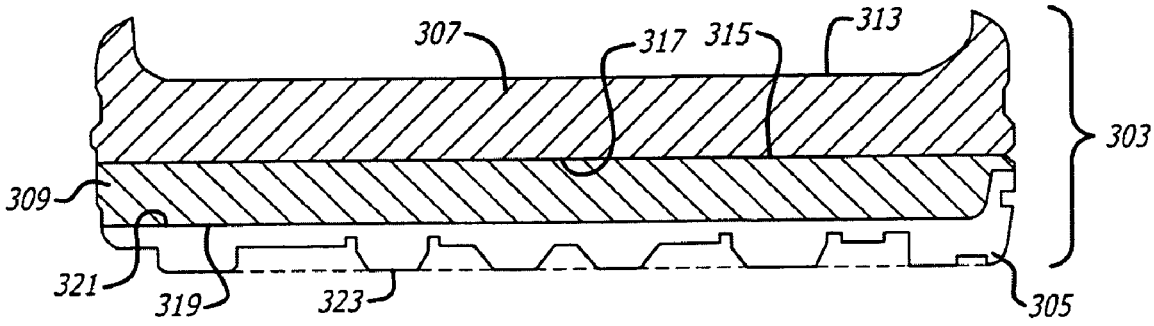
FIG. 4 is a front elevation view in cross section of the midsole and outsole of the shoe in FIG. 3 along line 4-4 in the direction of the appended arrows.

FIG. 4 shows a front elevation view in cross section of the midsole 303 shown in FIG. 3 along line 4-4 in the direction of the appended arrows. As shown in FIG. 4, the bottom surface 315 of the upper layer 307 is in substantially continuous contact with the top surface 317 of the lower layer 309. The cross sectional shape of the bottom surface 315 and the top surface 317 at line 4-4 is shown in FIG. 4 by a substantially horizontal line that extends from the lateral side of the midsole 303 to the medial side.

Figure 5:
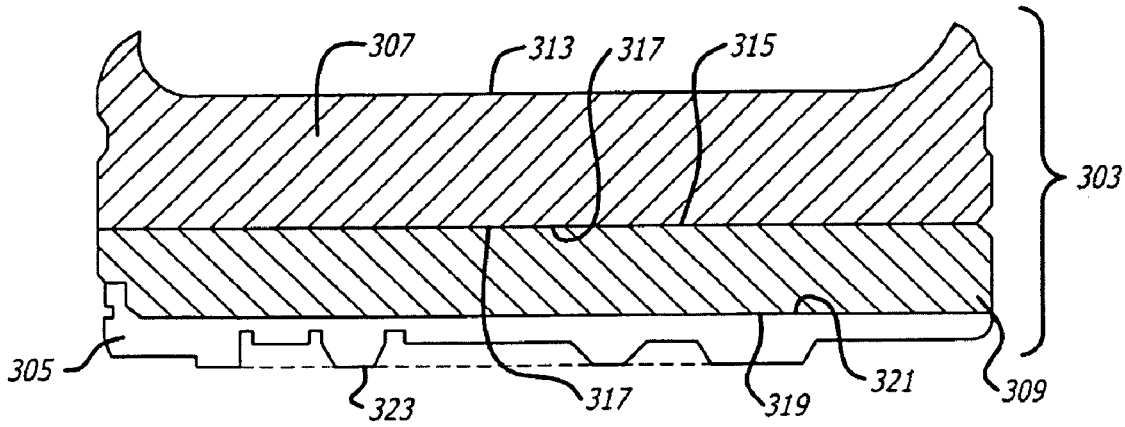
FIG. 5 is a front elevation view in cross section of the midsole and outsole of the shoe in FIG. 3 along line 5-5 in the direction of the appended arrows.

FIG. 5 shows a front elevation view in cross section of the midsole 303 shown in FIG. 3 along line 5-5 in the direction of the appended arrows. As shown in FIG. 5, the bottom surface 315 of the upper layer 307 is in substantially continuous contact with the top surface 317 of the lower layer 309. The cross sectional shape of the bottom surface 315 and the top surface 317 at line 5-5 is shown in FIG. 5 by a substantially horizontal line that extends from the lateral side of the midsole 303 to the medial side.

Figure 6:
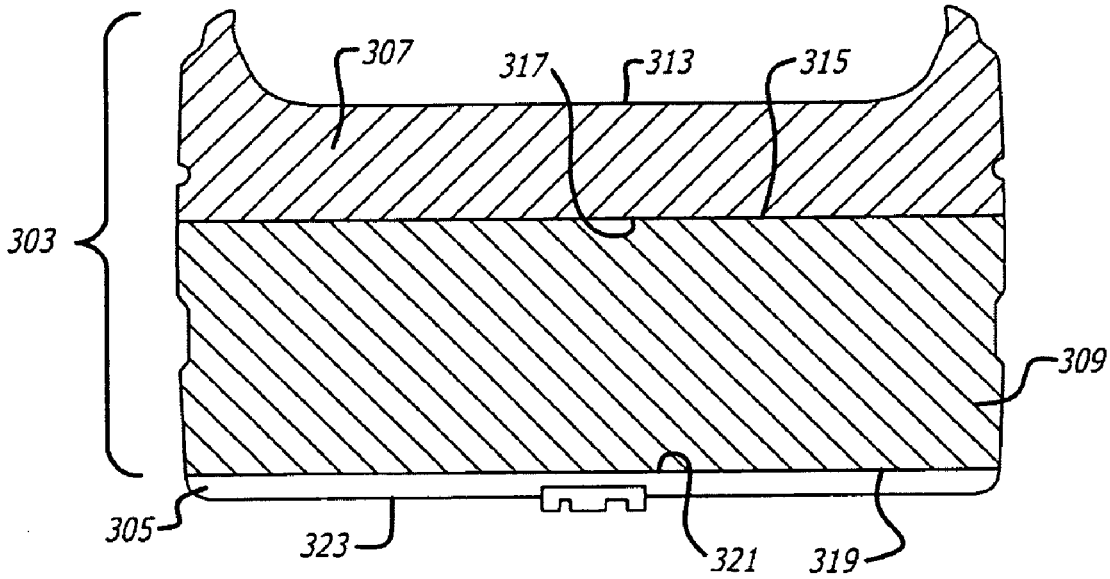
FIG. 6 is a front elevation view in cross section of the midsole and outsole of the shoe in FIG. 3 along line 6-6 in the direction of the appended arrows.

FIG. 6 shows a front elevation view in cross section of the midsole 303 shown in FIG. 3 along line 6-6 in the direction of the appended arrows. As shown in FIG. 6, the bottom surface 315 of the upper layer 307 is in substantially continuous contact with the top surface 317 of the lower layer 309. The cross sectional shape of the bottom surface 315 and the top surface 317 at line 6-6 is shown in FIG. 6 by a substantially horizontal line that extends from the lateral side of the midsole 303 to the medial side.

Figure 7:
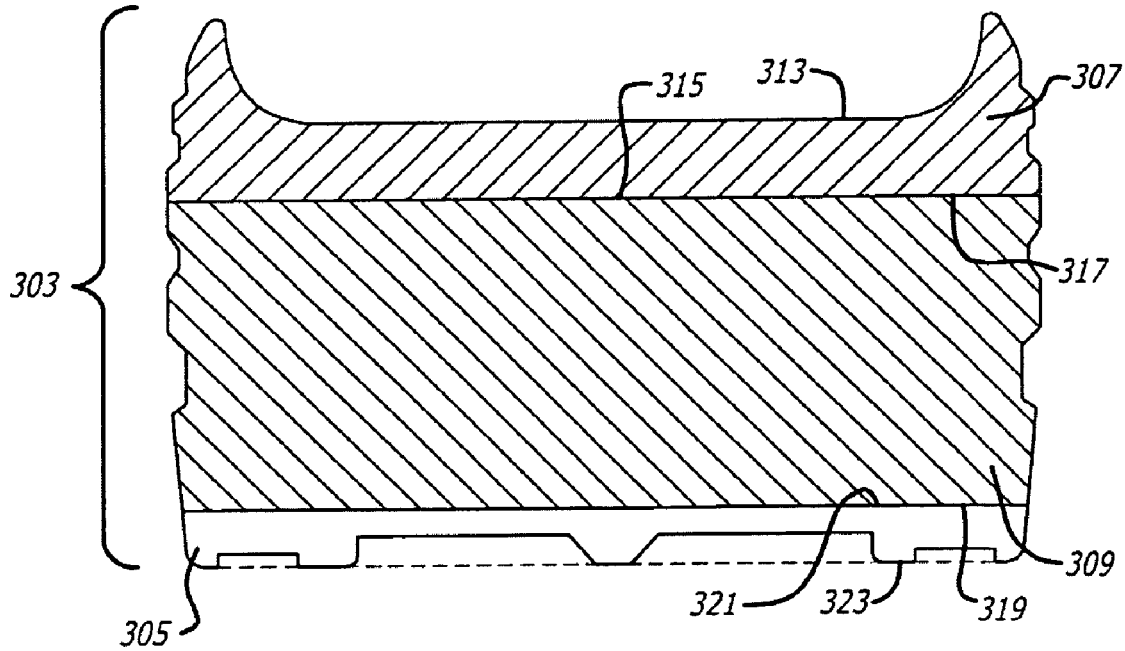
FIG. 7 is a front elevation view in cross section of the midsole and outsole of the shoe in FIG. 3 along line 7-7 in the direction of the appended arrows.

FIG. 7 shows a front elevation view in cross section of the midsole 303 shown in FIG. 3 along line 7-7 in the direction of the appended arrows. As shown in FIG. 7, the bottom surface 315 of the upper layer 307 is in substantially continuous contact with the top surface 317 of the lower layer 309. The cross sectional shape of the bottom surface 315 and the top surface 317 at line 7-7 is shown in FIG. 7 by a substantially horizontal line that extends from the lateral side of the midsole 303 to the medial side.

As shown in FIGS. 4-7, the cross sectional of the midsole 303 is of varying thickness, with there generally being a progression in thickness as the midsole 303 moves from the toe region to the heel region.

In preferred embodiments, the top surface 317 of the lower layer 309 of the midsole 303 is in substantially continuous contact with the bottom surface 315 of the upper layer 307 of the midsole. Due to this substantially continuous contact between top surface 317 and bottom surface 315 in these preferred embodiments, each convexity in the bottom surface 315 has a corresponding concavity in the top surface 317 and each concavity in the bottom surface 315 has a corresponding convexity in the top surface 317. In other embodiments, such substantially continuous contact between top surface 317 and bottom surface 315 may not be present.

The invention will now be described with reference to an alternative embodiment shown in FIGS. 8 and 8A. This embodiment shows a side elevation view in cross section of the midsole 803 and the outsole 805 of the shoe.

The midsole 803, as shown, comprises two layers. Typically, the lower layer 809 of the midsole is on average thicker in the heel region 863 of the shoe than it is in the toe region 861. Typically, the thickness of the lower layer 809 is less than about 45 millimeters thick in the heel region 863 of the shoe and has an average thickness in the heel region 863 of at least about 6.5 millimeters, and is less than about 25 millimeters thick in the middle region 862 and the toe region 861 of the shoe and has an average thickness in the middle region 862 and the toe region 861 of at least about 3 millimeters. The upper layer 807 has a first density and the lower layer 809 has a second density different from the first density and is typically less dense than the first density. The upper layer 807 has a first compressibility and the lower layer 809 has a second compressibility that is different from the first compressibility. The compressibility of the lower layer 809 is typically relatively high. Due to this relatively high compressibility, the lower layer 809 undergoes a relatively high amount of deformation when subjected to a given load. The upper layer 807 is typically made from polyurethane, polyvinyl chloride, rubber or thermal plastic rubber. However, the upper layer 807 can be made from any other material without departing from the scope of the present invention. Typically the upper layer 807 will have a density of between about 0.400 and about 0.500 grams per cubic centimeter and a durometer between about 50 and about 75 Shore A (ASTM D2240). The lower layer 809 is made of a compressible and deformable yet resilient material which may or may not be the same material of which the upper layer 807 is made. Typically the lower layer 809 will have a density of between about 0.325 and about 0.419 grams per cubic centimeter and a durometer between about 15 and about 38 Shore A (ASTM D2240). The top surface 813 of the upper layer 807 is typically positioned below an insole board (not shown) which is typically positioned below the sockliner 801. The upper layer 807 has a bottom surface 815 that is located above the top surface 817 of the lower layer 809. The lower layer 809 has a bottom surface 821. The outsole 805 has a top surface 819. The bottom surface 821 of the lower layer 809 is located above the top surface 819 of the outsole 805.

Figure 8:
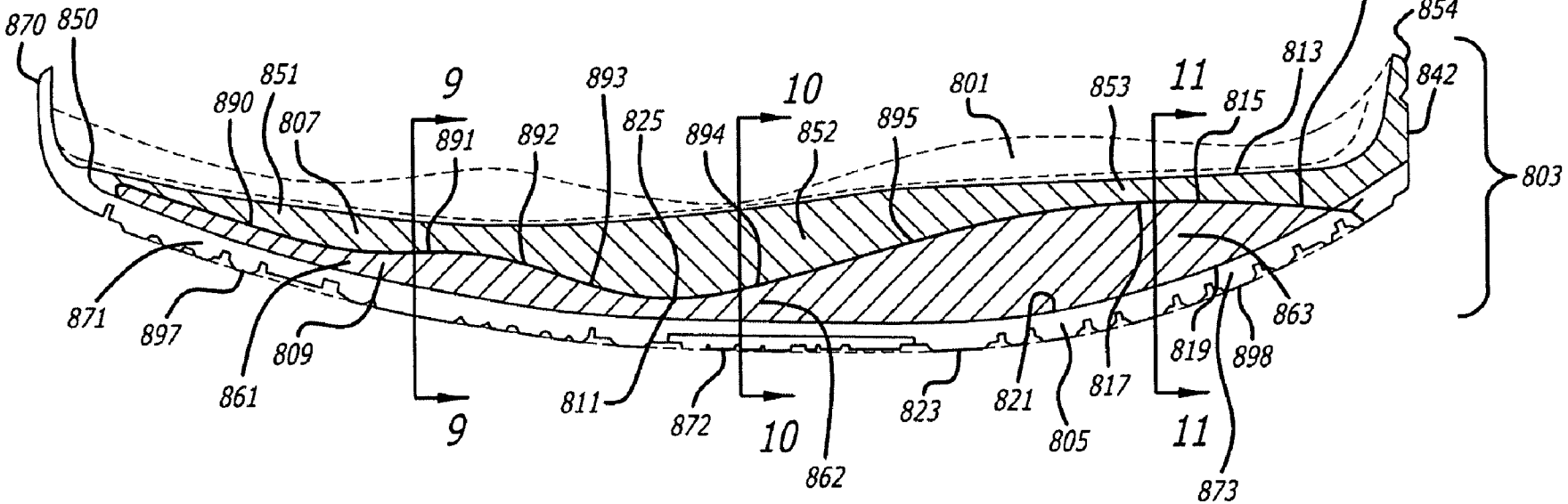
FIG. 8 is a side elevation view in cross section of a second alternative embodiment of the midsole and outsole of the shoe.
Figure 8A:
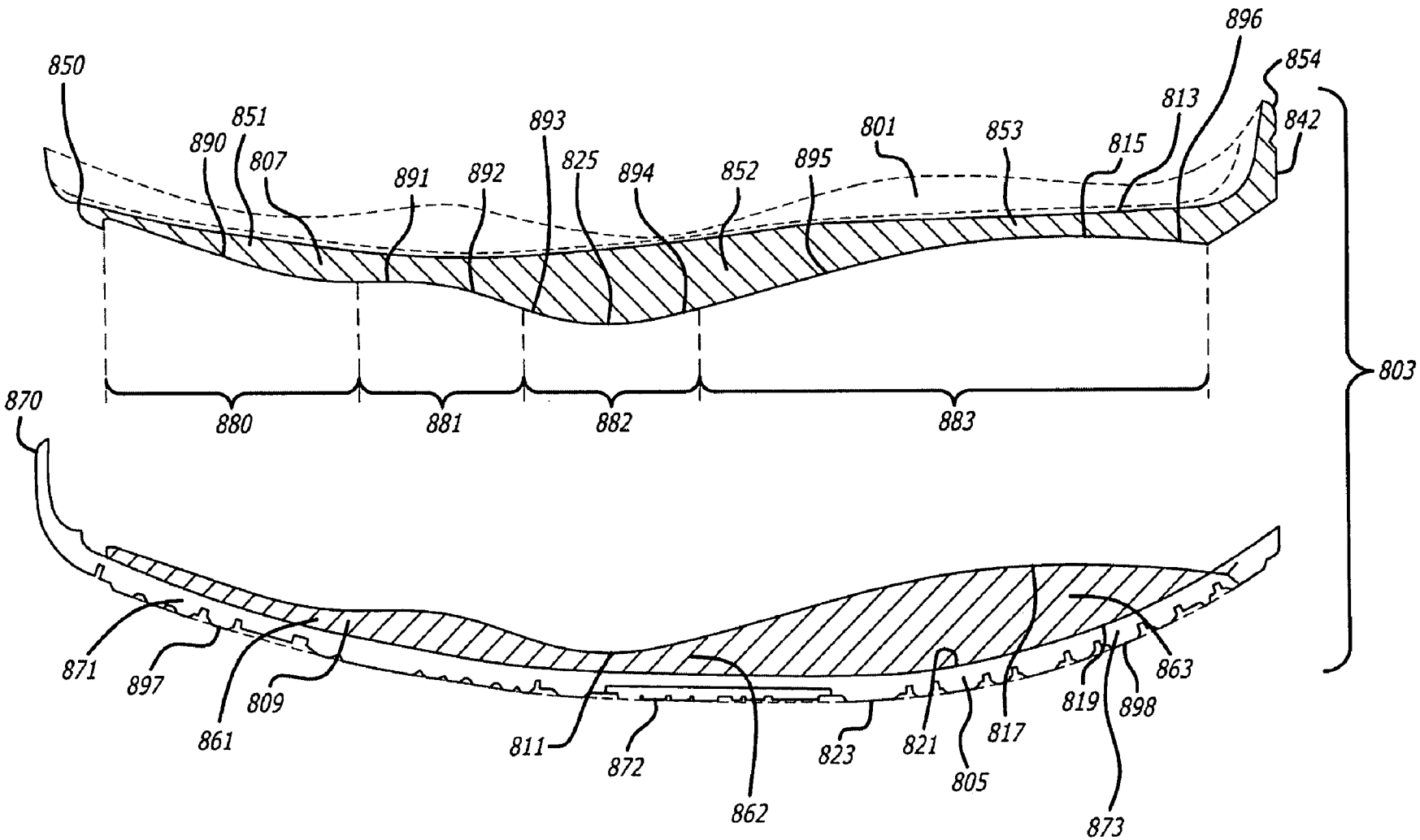
FIG. 8A an exploded view of FIG. 8.

The bottom surface 815 of the upper layer 807, as shown in a preferred embodiment in FIG. 8A, has a convexity 880 that comprises at least a downward curve 890 located in at least a portion of the toe region 851. The downward curve 890 of convexity 880 begins at, or near the vicinity of, the frontmost point 850 of the upper layer 807 and gradually and continuously descends downwardly from there through at least a portion of the toe region 851. The portion of the upper layer 807 indicated by lines extending from, and associated with, element number 880 indicates the approximate range wherein convexity 880 is typically primarily located. Convexity 880 may, or may not, be entirely located within the range indicated by the lines extending from, and associated with, element number 880. Convexity 880, as shown in a preferred embodiment in FIG. 8A, is relatively shallow due to its large radius, or radii, of curvature. Convexity 880 may comprise a curve or curves in addition to downward curve 890. The radius of curvature throughout convexity 880 may be completely constant, may have one or more constant portions mixed with one or more non-constant portions, or may be completely non-constant. Downward curve 890, as well as any other curve or curves that are part of convexity 880, may, at any point on any of those curves, have a slope somewhere between negative infinity and positive infinity and can include a slope that is zero, gradual, moderate, steep, vertical or somewhere between any of those amounts. Although the downward curve 890 of convexity 880 is shown in FIG. 8A as beginning near the frontmost point 850, downward curve 890 of convexity 880 may instead begin at some other location on the upper layer 807. Although convexity 880 is shown in FIG. 8A as ending at a location in the toe region 851, convexity 880 may instead end at some other location on the upper layer 807. Only a portion of convexity 880 may be located in the toe region 851. Alternatively, all or substantially all of convexity 880 may be located in the toe region 851. Convexity 880, or a portion thereof, may occupy all of the toe region 851. Alternatively, convexity 880, or a portion thereof, may occupy a substantial portion of the toe region 851. Convexity 880 has a first wavelength and a first amplitude.

The bottom surface 815 of the upper layer 807, as shown in FIG. 8A, has a concavity 881 that comprises at least an upward curve 891 located in at least a portion of the toe region 851. In this preferred embodiment, concavity 881 further comprises at least a downward curve 892. Upward curve 891 may or may not be contiguous with downward curve 892. Upward curve 891 ascends upwardly in at least a portion of the toe region 851. Downward curve 892 descends downwardly in at least a portion of the toe region 851. The portion of the upper layer 807 indicated by lines extending from, and associated with, element number 881 indicates the approximate range wherein concavity 881 is typically primarily located. Concavity 881 may, or may not, be entirely located within the range indicated by the lines extending from, and associated with, element number 881. Concavity 881 has a relatively shallow depression due to its relatively long radius, or radii, of curvature. Concavity 881 may comprise a curve or curves in addition to upward curve 891 and downward curve 892. The radius of curvature throughout concavity 881 may be completely constant, may have one or more constant portions mixed with one or more non-constant portions, or may be completely non-constant. Upward curve 891, downward curve 892, as well as any other curve or curves that are part of concavity 881, may, at any point on any of those curves, have a slope somewhere between negative infinity and positive infinity and can include a slope that is zero, gradual, moderate, steep, vertical or somewhere between any of those amounts. Although the upward curve 891 of concavity 881 is shown in FIG. 8A as beginning at a location near where the toe region 851 and the middle region 852 transition into one another, the upward curve 891 of concavity 881 could instead begin at some other location on the upper layer 807. Although the upward curve 891 of concavity 881 is shown in FIG. 8A as ending at a location near the transition between the toe region 851 and the middle region 852, upward curve 891 may instead end at some other location on the upper layer 807. Although the downward curve 892 of concavity 881 is shown in FIG. 8A as beginning near the transition between the toe region 851 and the middle region 852 and ending in the vicinity of the middle region 852, downward curve 892 of concavity 881 may instead begin at some other location on the upper layer 807 and end at some other location on the upper layer 807. Convexity 880 may or may not be contiguous with concavity 881. Only a portion of concavity 881 may be located in the in toe region 851. Alternatively, all or substantially all of concavity 881 may be located in the toe region 851. Concavity 881 has a second wavelength that is typically different from the first wavelength of convexity 880. Concavity 881 has a second amplitude that is typically different from the first amplitude of convexity 880.

The bottom surface 815 of the upper layer 807, as shown in FIG. 8A, has a convexity 882 that comprises at least a downward curve 893 located in at least a portion of the middle region 852. In this preferred embodiment, convexity 882 further comprises at least an upward curve 894. Downward curve 893 may or may not be contiguous with upward curve 894. Downward curve 893 descends downwardly in at least a portion of the middle region 852. Upward curve 894 ascends upwardly in at least a portion of the middle region 852. The portion of the upper layer 807 indicated by lines extending from, and associated with, element number 882 indicates the approximate range wherein convexity 882 is typically primarily located. Convexity 882 may, or may not, be entirely located within the range indicated by the lines extending from, and associated with, element number 882. Convexity 882 has a relatively moderate bulge due to its relatively moderate radius, or radii, of curvature. Convexity 882 may comprise a curve or curves in addition to downward curve 893 and upward curve 894. The radius of curvature throughout convexity 882 may be completely constant, may have one or more constant portions mixed with one or more non-constant portions, or may be completely non-constant. Downward curve 893, upward curve 894, as well as any other curve or curves that are part of convexity 882, may, at any point on any of those curves, have a slope somewhere between negative infinity and positive infinity and can include a slope that is zero, gradual, moderate, steep, vertical or somewhere between any of those amounts. Although the downward curve 893 of convexity 882 is shown in FIG. 8A as beginning near the middle of the middle region 852 and ending near the middle of the middle region 852, downward curve 893 of convexity 882 may instead begin at some other location on the upper layer 807 and end at some other location on the upper layer 807. Although the upward curve 894 of convexity 882 is shown in FIG. 8A as beginning near the middle of the middle region 852 and ending in the middle region at a location near the heel region 853, upward curve 894 of convexity 882 may instead begin at some other location on the upper layer 807 and end at some other location on the upper layer 807. Convexity 882 may or may not be contiguous with concavity 881. Only a portion of convexity 882 may be located in the in middle region 852. Alternatively, all or substantially all of convexity 882 may be located in the middle region 852. Convexity 882, or a portion thereof, may occupy all of the middle region 852. Alternatively, convexity 882, or a portion thereof, may occupy a substantial portion of the middle region 852. Convexity 882 has a third wavelength that is typically different from both the first wavelength of convexity 880 and the second wavelength of concavity 881. Convexity 882 has a third amplitude that is typically different from both the first amplitude of convexity 880 and the second amplitude of concavity 881.

The bottom surface 815 of the upper layer 807, as shown in FIG. 8A, has a concavity 883 that comprises at least an upward curve 895 located in at least a portion of the heel region 853. In this preferred embodiment, concavity 883 further comprises at least a downward curve 896. Upward curve 895 may or may not be contiguous with downward curve 896. Upward curve 895 ascends upwardly in at least a portion of the heel region 853. Downward curve 896 descends downwardly in at least a portion of the heel region 853. The portion of the upper layer 807 indicated by lines extending from, and associated with, element number 883 indicates the approximate range wherein concavity 883 is typically primarily located. Concavity 883 may, or may not, be entirely located within the range indicated by the lines extending from, and associated with, element number 883. Concavity 883 has a relatively moderate depression due to its relatively moderate radius, or radii, of curvature. Concavity 883 may comprise a curve or curves in addition to upward curve 895 and downward curve 896. The radius of curvature throughout concavity 883 may be completely constant, may have one or more constant portions mixed with one or more non-constant portions, or may be completely non-constant. Upward curve 895, downward curve 896, as well as any other curve or curves that are part of concavity 883, may, at any point on any of those curves, have a slope somewhere between negative infinity and positive infinity and can include a slope that is zero, gradual, moderate, steep, vertical or somewhere between any of those amounts. Although the upward curve 895 of concavity 883 is shown in FIG. 8A as beginning at a location in the middle region 852, the upward curve 895 of concavity 883 could instead begin at some other location on the upper layer 807. Although the upward curve 895 of concavity 883 is shown in FIG. 8A as ending at a location near the middle of the heel region 853 of the upper layer 807, upward curve 895 may instead end at some other location on the upper layer 807. Although the downward curve 896 of concavity 883 is shown in FIG. 8A as beginning near the middle of the heel region 853 and ending in the vicinity of the rearmost point 854 of the upper layer 807, downward curve 896 of concavity 883 may instead begin at some other location on the upper layer 807 and end at some other location on the upper layer 807. Convexity 882 may or may not be contiguous with concavity 883. Only a portion of concavity 883 may be located in the in heel region 853. Alternatively, all or substantially all of concavity 883 may be located in the heel region 853. Concavity 883, or a portion thereof, may occupy all of the heel region 853. Alternatively, concavity 883, or a portion thereof, may occupy a substantial portion of the heel region 853. Concavity 883 has a fourth wavelength that is typically different from the first wavelength of convexity 880, the second wavelength of concavity 881, and the third wavelength of convexity 882. Concavity 883 has a fourth amplitude that is typically different from the first amplitude of convexity 880, the second amplitude of concavity 881, and the third amplitude of convexity 882.

As further shown in the embodiment in FIG. 8, the top surface 817 of the lower layer 809 of the midsole 803 is in substantially continuous contact with the bottom surface 815 of the upper layer 807 of the midsole. Due to this substantially continuous contact between top surface 817 and bottom surface 815 in this embodiment, each convexity in the bottom surface 815 has a corresponding concavity in the top surface 817 and each concavity in the bottom surface 815 has a corresponding convexity in the top surface 817. In other embodiments, such substantially continuous contact between top surface 817 and bottom surface 815 may not be present.

The outsole 805 has a top surface 819 and a bottom surface 823. The outsole 805 may curve upwardly in the heel region 873. When the shoe is in its typical upright, unloaded state, the frontmost point 870 is relatively high above the ground. In this embodiment, from a point at or near the vicinity of the frontmost point 870, the outsole 805 has a gradual downward curve 897 that continues through at least a portion of the toe region 861 of the outsole 805, then continues to curve gradually downward in the middle region 872 of the outsole and then begins to curve upwardly forming an upward curve 898 in the heel region 873 of the outsole 805. This gradual upward curve 898 typically continues until the outsole 805 approaches the vicinity of the rear tip 842 of the shoe. This upward curve 898 is typically sharper than the curve in the toe region 871. Upward curve 898 may be substantially sharper than shown in FIG. 8A or substantially shallower than shown in FIG. 8A. The bottom surface 823 of the outsole 805 typically contains grooves and/or patterns for optimal traction and wear.

Figure 9:
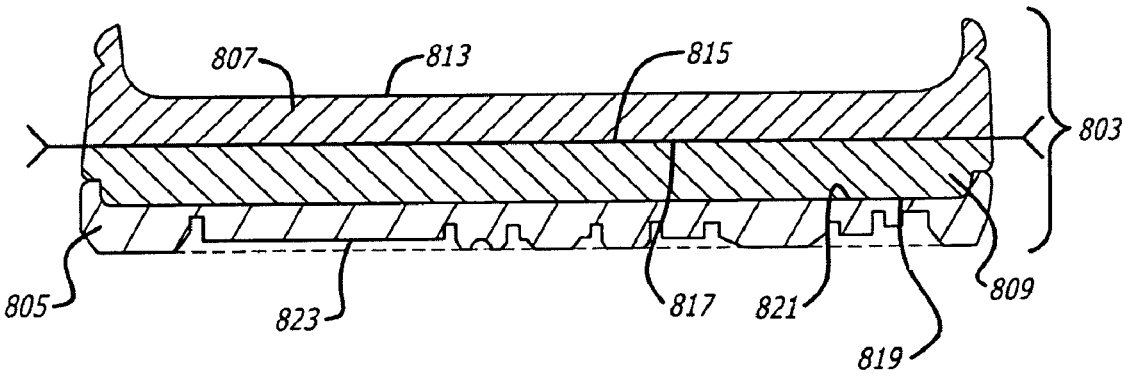
FIG. 9 is a front elevation view in cross section of the midsole and outsole of the shoe in FIG. 8 along line 9-9 in the direction of the appended arrows.

FIG. 9 shows a front elevation view in cross section of the midsole 803 shown in FIG. 8 along line 9-9 in the direction of the appended arrows. As shown in FIG. 9, the bottom surface 815 of the upper layer 807 is in substantially continuous contact with the top surface 817 of the lower layer 809. The cross sectional shape of the bottom surface 815 and the top surface 817 at line 9-9 is shown in FIG. 9 by a substantially horizontal line that extends from the lateral side of the midsole 803 to the medial side.

Figure 10:
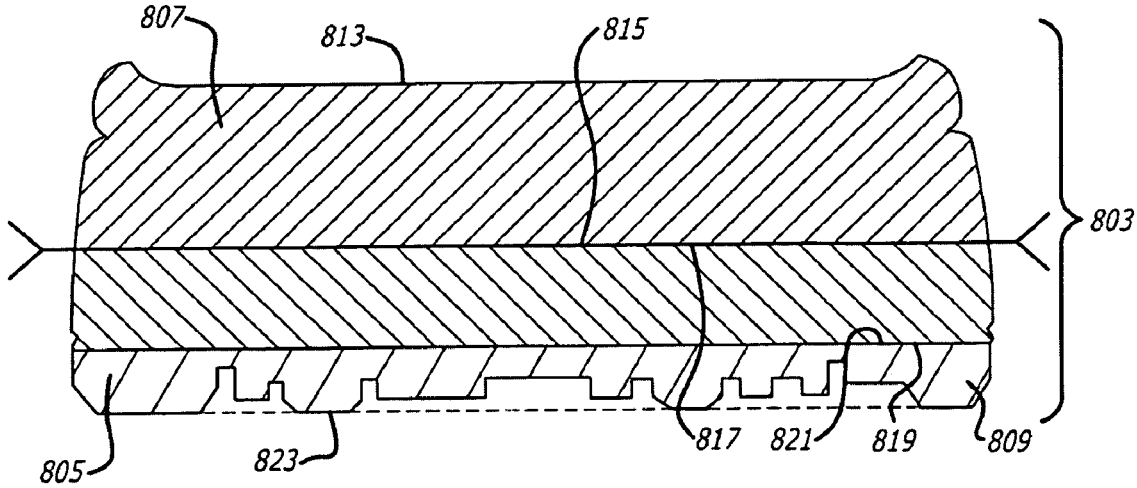
FIG. 10 is a front elevation view in cross section of the midsole and outsole of the shoe in FIG. 8 along line 10-10 in the direction of the appended arrows.

FIG. 10 shows a front elevation view in cross section of the midsole 803 shown in FIG. 8 along line 10-10 in the direction of the appended arrows. As shown in FIG. 10, the bottom surface 815 of the upper layer 807 is in substantially continuous contact with the top surface 817 of the lower layer 809. The cross sectional shape of the bottom surface 815 and the top surface 817 at line 10-10 is shown in FIG. 10 by a substantially horizontal line that extends from the lateral side of the midsole 803 to the medial side.

Figure 11:
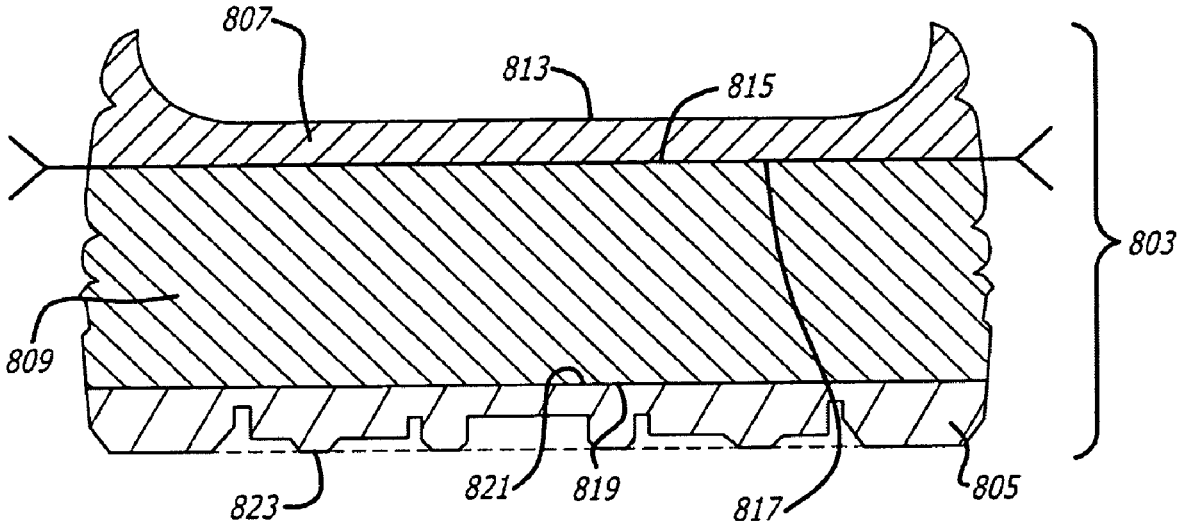
FIG. 11 is a front elevation view in cross section of the midsole and outsole of the shoe in FIG. 8 along line 11-11 in the direction of the appended arrows.

FIG. 11 shows a front elevation view in cross section of the midsole 803 shown in FIG. 8 along line 11-11 in the direction of the appended arrows. As shown in FIG. 11, the bottom surface 815 of the upper layer 807 is in substantially continuous contact with the top surface 817 of the lower layer 809. The cross sectional shape of the bottom surface 815 and the top surface 817 at line 11-11 is shown in FIG. 11 by a substantially horizontal line that extends from the lateral side of the midsole 803 to the medial side.

As shown in FIGS. 9-11, the midsole 803 is of varying thickness, with there generally being a progression in thickness as the midsole 803 moves from the toe region 851 to the heel region 853.

In normal use of the shoe, the user steps forward with the rear portion of the user's heel stepping on the ground first. When this happens, the lower layer 809 of the midsole 803 in the heel region 853 that is made of less dense and more readily compressible material, compresses and deforms, causing the heel of the user's foot to sink toward the ground to a greater extent than it would sink while wearing a conventional shoe. Due to the concavity 883, the lower layer 809 is relatively thick in the heel region 863. Since this relatively thick heel region 863 of the lower layer 809 is also relatively soft and highly compressible, it mimics the effect of walking on a sandy beach, thereby requiring the user to exert more energy while walking than would be required when walking while wearing conventional shoes. Additionally, since the heel region 863 of the lower layer 809 is relatively thick and highly compressible, it has a degree of inherent lateral and transverse instability that is not present in conventional shoes. This inherent instability forces the user to make a balancing effort and use muscles and muscle control and coordination to maintain a normal walking gait that would not be required with conventional shoes.

As the step continues, the user's weight shifts to the center of the shoe and the shoe rolls forward in a smooth motion without the user having to overcome any abrupt pivot points. The lower layer 809 of the midsole 803 in the middle region 862 and then in the toe region 861, compresses and deforms, allowing the user's foot in those regions to sink toward the ground more than it would sink if the user were wearing conventional shoes. The convexities 880, 882 in the toe region 861 and/or middle region 862, limit compression of the lower layer 809 in those areas and thereby provide stability. The user then completes the step by pushing off with the forefoot ball region of the user's foot. All of this simulates the effects and the fitness benefits of walking on a sandy beach or on a giving or uneven soft surface regardless of the actual hardness of the surface.

While the foregoing detailed description sets forth exemplary embodiments of a shoe in accordance with the present invention, it is to be understood that the above description is illustrative only and not limiting of the disclosed invention. Indeed, it will be appreciated that the embodiments discussed above and the virtually infinite embodiments that are not mentioned could easily be within the scope and spirit of the present invention.

What is claimed is:

1. A shoe having an upper, a midsole, and an outsole wherein said midsole comprises:

an upper layer and a lower layer wherein the lower layer has a bottom surface substantially adjacent to the outsole and a top surface substantially opposite the bottom surface of the lower layer, the lower layer being located substantially between the outsole and the upper layer, said upper layer having a bottom surface that substantially faces said top surface of said lower layer, said upper layer further having a heel region, said bottom surface of said upper layer further having at least a first convexity, a second convexity, and a first concavity, said first concavity occupying substantially all of said heel region of said bottom surface, and said upper layer and said lower layer each having a density wherein the density of the upper layer is denser than the density of the lower layer;

said upper layer further having a toe region and a middle region and at least a substantial portion of said first convexity is located in said toe region and at least a substantial portion of said second convexity is located in said middle region.

2. The shoe of claim 1 wherein the upper layer of the midsole has a density of between about 0.400 and about 0.500 grams per cubic centimeter, and the lower layer of the midsole has a density of between about 0.325 and about 0.419 grams per cubic centimeter.

3. The shoe of claim 1 wherein the lower layer of the midsole has a toe region, a middle region and a heel region and the lower layer is on average thicker in the heel region than it is in the toe region.

4. The shoe of claim 3 wherein the lower layer of the midsole is less than about 45 millimeters thick in said heel region and has an average thickness in said heel region of at least about 6.5 millimeters, and said lower layer is less than about 25 millimeters thick in said toe region and said middle region and has an average thickness in said toe region and said middle region of at least about 3 millimeters.

5. The shoe of claim 1 wherein the upper layer and lower layer of the midsole are molded together.

6. A shoe having an upper, a midsole, and an outsole wherein said midsole comprises:

an upper layer and a lower layer wherein the lower layer has a bottom surface substantially adjacent to the outsole and a top surface substantially opposite the bottom surface of the lower layer, the lower layer being located substantially between the outsole and the upper layer, said upper layer having a bottom surface that substantially faces said top surface of said lower layer, said upper layer further having a heel region, said bottom surface of said upper layer further having at least a first concavity and a second concavity, said second concavity occupying substantially all of said heel region of said bottom surface, and said upper layer and said lower layer each having a density wherein the density of the upper layer is denser than the density of the lower layer;

wherein said upper layer has a toe region and at least a portion of said first concavity is located in said toe region.

7. The shoe of claim 6 wherein the upper layer of the midsole has a density of between about 0.400 and about 0.500 grams per cubic centimeter, and the lower layer of the midsole has a density of between about 0.325 and about 0.419 grams per cubic centimeter.

8. The shoe of claim 6 wherein the lower layer of the midsole has a toe region, a middle region and a heel region and is on average thicker in the heel region than it is in the toe region.

9. The shoe of claim 6 wherein the upper layer and lower layer of the midsole are molded together.

* * * * *